United States Patent [19]

Rundall

[11] Patent Number: 4,522,391

[45] Date of Patent: Jun. 11, 1985

[54] EXERCISING DEVICE

[76] Inventor: George Rundall, 7701 Warner Ave., Apt. Q-231, Huntington Beach, Calif. 92647

[21] Appl. No.: 381,435

[22] Filed: May 24, 1982

[51] Int. Cl.[3] ..... A63B 21/04

[52] U.S. Cl. ..... 272/62; 272/900; 272/138; 272/144

[58] Field of Search ..... 272/109, 79, 126, 63, 272/135–139, 144, 145, 143, 62, 96, 97, 61, 900, 125, 134, 142, 93; 128/75, 70, 68.1, 25, 25 B

[56] References Cited

U.S. PATENT DOCUMENTS

| | | | |
|---|---|---|---|
| 781,683 | 2/1905 | Shepherd | 272/900 |
| 1,456,317 | 5/1923 | Lauer | 272/145 |
| 1,623,670 | 4/1927 | Frankenfeld | 272/138 |
| 1,705,745 | 3/1929 | Anderson | 272/134 |
| 1,746,111 | 2/1930 | Fisher | 272/126 |
| 1,902,694 | 3/1933 | Edwards | 272/144 X |
| 2,335,290 | 11/1943 | Medaris | 272/126 |
| 2,684,109 | 7/1954 | Youmans | 272/93 |
| 2,839,299 | 6/1958 | Weiss | 272/900 |
| 3,106,395 | 10/1963 | Birkenbeul et al. | 272/127 |
| 3,178,180 | 4/1965 | Morgan | 272/145 |
| 3,606,321 | 9/1971 | Macoulis | 272/142 |
| 4,019,734 | 4/1977 | Lee et al. | 272/143 |
| 4,245,840 | 1/1981 | Van Housen | 272/137 |
| 4,257,592 | 3/1981 | Jones | 272/126 |
| 4,304,401 | 12/1981 | Goodman | 272/136 |
| 4,456,248 | 6/1984 | Smith | 272/145 |

FOREIGN PATENT DOCUMENTS

| | | | |
|---|---|---|---|
| 1148921 | 5/1963 | Fed. Rep. of Germany | 272/134 |
| 1421162 | 4/1965 | France | 272/900 |

OTHER PUBLICATIONS

*Black Belt* Magazine, Mar. 1973, p. 55.

Nautilus Body Conditioning Catalog, Nautilus Sports/-Medical Industries, P.O. Box 5000, Deland, Fl. 32720, See p. 4.

*Primary Examiner*—Richard J. Apley

*Assistant Examiner*—S. R. Crow

*Attorney, Agent, or Firm*—Weissenberger and Peterson

[57] ABSTRACT

A device to allow a person to bend forward and place the upper portion of his body above the pelvic region in an inverted position across a padded support placed in a doorway, while stretching his legs out and away from the padded cylinder in a direction generally perpendicular to his inverted body. The feet of the user are restrained through straps secured to a lower portion of the doorway. The user is able to stretch his legs out away from each other, away from his body, either singly or in unison, and can also swing the upper portion of his body above the pelvic region using the padded support as a fulcrum.

8 Claims, 5 Drawing Figures

EXERCISING DEVICE

BACKGROUND OF THE INVENTION

This invention relates to exercising devices in general, and in particular to devices for exercising the back of the user. It also relates to exercising devices of the type which may be mounted in a door frame.

In the prior art it is well-known that suspending the portion of the body lying above the pelvis in an upside-down position helps to relieve backaches and other physical problems related to spinal compression. In particular, this exercise is helpful in correcting a condition in which a scoliosis curve in the spinal cord may occur from a misalignment thereof. This misalignment may cause tension in the back of a person and pinch his nerve ends. The problem tends to get worse unless the scoliotic curve is properly addressed.

Devices are known in the prior art that permit the user to suspend the upper part of his body. For example, U.S. Pat. No. 3,593,708 to Victor Steele shows a device for suspending a person's body above the pelvic region in an inverted position by positioning a trapeze bar in a door frame; the person resting his pelvic region on pade provided on the trapeze bar, and bending forward. Steele does not allow the legs of the user to be stretched out while the upper portion of his body is suspended in an inverted manner, and contemplates that the legs of the user should be maintained in a bent position, and the feet of the user supported above the pelvis by support means. This position of the user's body does not allow the back muscles of the user to be fully stretched since the leg muscles do not apply a pull on the back muscles. In particular, with the exercising device of Steele, the spinal cord and associated muscles around the pelvic region are not fully exercised.

U.S. Pat. No. 3,178,180 to Morgan shows a back stretcher for forcibly bending and exercising the back and the back muscles of the body. In this device the user maintains his feet strapped to a platform and attempts to bend backwards over a yieldable strap and grasps handles 36 positioned on the platform. Here again, the legs of the user are not permitted to stretch out when the body of the user above the pelvis is suspended in an inverted manner.

U.S. Pat. No. 3,874,375 to Penner shows an exercise apparatus which uses a suspended padded knee bar and a padded toe bar spaced therefrom. The user hangs upside-down by positioning his knees over the knee bar and hooking his feet under the toe bar. When the user hangs upside-down his feet are engaged by the toe bar and cannot be moved. A ladder is provided to assist the user to position his knees across the knee bar.

It can be seen that while it has been recognized that there is a therapeutic value in using exercising devices that allow the upper region of the human body above the pelvis to be suspended in an inverted position, and prior devices permit a user to accomplish this, the prior art devices have not allowed the legs of the user to be stretched out in a direction substantially perpendicular to his inverted upper body portion so that the legs may apply an additional pull on the back muscles and the spinal cord.

SUMMARY OF THE INVENTION

In accordance with the present invention, it has been found that the back of a person can be exercised more effectively when the person not only suspends his body portion above the pelvic region in an inverted manner, but also stretches his legs apart and also out and away from his pelvic region, generally perpendicular to his inverted upper body portion. The exercise can become even more effective when the legs of the user are free to be moved jointly or separately in any direction desired in a restrained manner.

The present invention provides an exercising device having a horizontal padded cylinder mounted at the height of the pelvic region of a person, and strap means extending from a base level to the height at which said padded cylinder is mounted. The strap means have loops into which the user may securely position his feet. The user bends over the padded cylinder with his feet in the loops of the straps. The straps are secured at the base level and restrain the feet of the user, while allowing the user to stretch his legs horizontally, out and away from the inverted upper portion of his body. With his legs stretched out, and the upper portion of his body hanging over the padded cylinder, the user can rock or swing the upper part of his body using the pelvic region as a pivot. The user may also move his feet apart, away from each other, as part of his exercising routine. Additionally, the user may move his legs to different heights, separately or together; or, the user can perform a "cycling" motion with his legs. In this manner, the back of the user can be exercised more effectively with three different forces acting on the back, to wit: the gravitational force, the pull of the legs and the momentum of the rocking motion.

The present invention utilizes the pull of gravity, augmented with the pull of the leg muscles, to gently stretch the spine of the user so that exercises can be done with less pain. Exercises done in this manner help to relieve tension and soreness in the upper back by pulling the upper back and neck into proper alignment. It also develops the back muscles so that the back of the user will retain an upright position when he is standing upright.

DESCRIPTION OF THE PREFERRED EMBODIMENT

Figure 1:
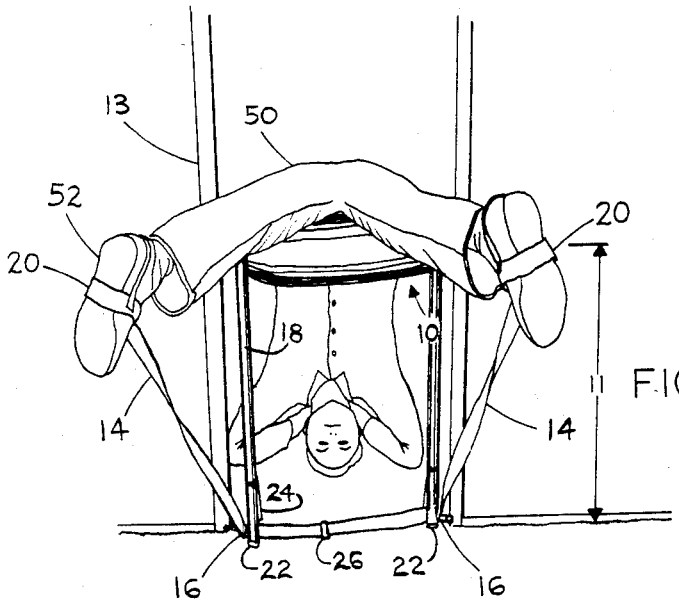
FIG. 1 is a perspective view of the device of this invention being used in a doorway.

Referring first to FIG. 1, reference 10 generally indicates an exercising device positioned in a doorway 13. The exercising device 10 comprises a horizontal support means in the form of a padded cylinder 12 securely mounted in the doorway 13 by suitable means at a height 11. The padded cylinder can support the weight of the user after it is mounted in the doorway. Additional support for the padded cylinder is provided by two upright support means 18, one at each end of the padded cylinder. The upright support means have legs 22 and 24 which rest on the ground. A strap means 14 slides through securing means 16 secured to the doorway 13 and also loop through legs 22 of the upright support means. The strap means 14 have loops 20, one at each end. A buckle 26 is provided whereby the strap means 14 may be adjusted in length.

FIG. 1 shows a user utilizing the present exercising device. The user 50 has his feet 52 secured in the loops 20 and the strap means 14 adjusted to his desired length, by means of buckle 26, and the upper region of his body above the pelvis inverted over the padded cylinder 12. The user is shown bent forward on the padded cylinder with his legs stretched out horizontally in a direction substantially perpendicular to the inverted upper portion of his body and with his face facing his feet. The strap means 14 restrain the feet 52 of the user 50 at substantially the height 11 of the padded cylinder 12. The user can hang passively in the position shown in FIG. 1 or engage in active exercise by rocking or swinging the inverted portion of his body up and down and sideways, using the padded cylinder as a pivot point and his arms for stability. The strap means 14 allow the user to stretch his legs out as well as to spread them apart. Since the legs are separately attached to the strap means, it is possible for the user to maintain his legs at different heights, i.e., keep his one leg at a first height and his second leg at a second height. The user may also move his legs in a "cycling" motion, i.e., as though he is riding a bicycle. The arrangement of the straps allow a great freedom to the legs of the user and he can use the movement of his legs to vary the pull of the leg muscles acting on the pelvic region and the back of the user while the upper portion of his body remains inverted over the padded cylinder 12.

Figure 2:
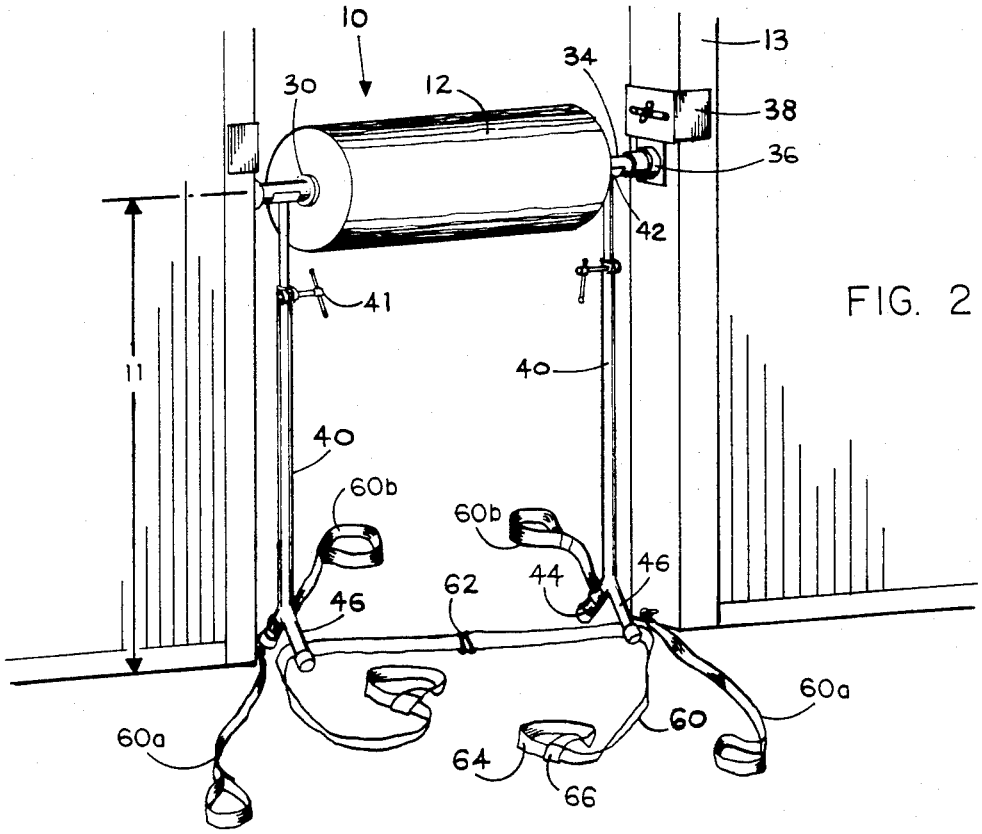
FIG. 2 is a perspective view showing the various components of the inventive device.

Having described the broad concepts and the principles of the present device in FIG. 1, details of the construction of the device will now be described in FIG. 2. In FIG. 2, the same numerals as in FIG. 1 represent similar elements. FIG. 2 shows the doorway 13 and the horizontal padded cylinder 12 mounted at a height 11. The padded cylinder 12 has a central cylindrical tubing 30 running therethrough. An extendable chinning bar 34 is inserted through the center tubing 30. Each end of the chinning bar fits in a conventional manner into a complementary cup 36 which is secured to the edge of the doorway by bracket means 38. The cup 36 and supporting bracket 38 are described with specificity in FIG. 3.

The bracket 38 serves to secure the cup 36 so as to prevent movement of the chinning bar 34 in the direction of passage through the doorway. After installation, the padded cylinder can rotate on the chinning bar 34 under the weight of the user. If desired, the padded cylinder may be made non-rotatable by appropriately securing the padded cylinder to the chinning bar and locking the chinning bar in the cups 36 by means such as cotter pins.

In addition to being secured by the cup 36, the chinning bar 34 may be supported by upright support means 40 placed at each end of the bar 34. The upright support means 40 are optional, but are preferably provided for added support and safety. The upright supports 40 are provided on their upper end with concave plates 42 on which the end portions of the chinning bar 34 rest. Further, the upright support means have on their lower ends legs 44 and 46 which serve to provide a ground support to the chinning bar 34. The divergence of the legs 44 and 46 provide stability of the support in the forward and backward direction. The divergence of the legs 44, 46 also allows the support means 40 to serve as an anchor for the strap 60, as will be explained in more detail hereafter. Two supports 40 are preferably utilized, one at each end of the chinning bar. The height of the supports 40 may be adjusted by conventional means such as 41.

Further in FIG. 2, the strap 60 is shown. The length of the strap 60 may be adjusted by buckle 62. At each end of the strap 60, loops 64 are provided. These loops may be adjusted by buckles 66. In the preferred embodiment of FIGS. 1 and 2, the strap 60 loops through legs 46 of the two supports 40 as shown in FIG. 2. In this arrangement the strap 60 can slide from side to side.

FIG. 2 also shows straps **60*a* and 60*b* which are optional embodiments of the single length of strap 60. The straps 60*a* and 60*b*** are discussed in more detail later.

Figure 3:
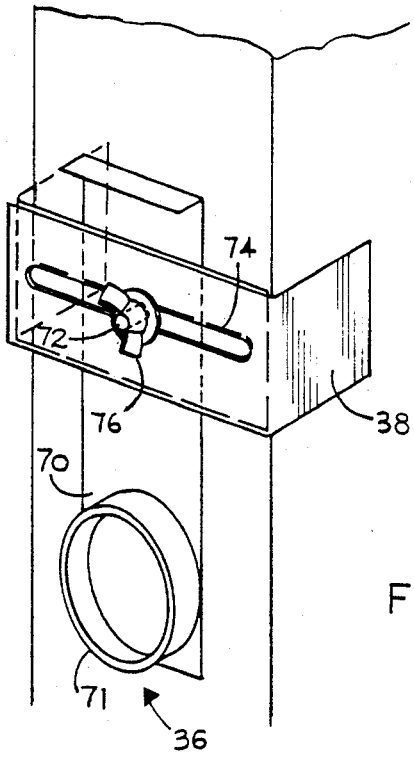
FIG. 3 is a perspective view of a bracket arrangement utilized in the inventive device.

Looking now to FIG. 3, the cup 36 and bracket 38 are shown in greater detail. The cup 36 has an integral cup receptacle 71 attached by means such as welding, to a flat plate 70. A screw member 72 is also integrally formed or secured on the flat plate 70, and is situated in an upright position. The brackets 38 are generally L-shaped brackets with longitudinal slots 74 in one arm of the L shape. The two brackets 38 are placed on the flat plate 70 and are positioned as shown with the screw member 72 protruding through the opening 74 of each of the brackets. A wing nut 76 screws down and holds the bracket in place. It can be seen that the brackets 38 can be relatively adjusted by means of longitudinal slots 74 to accommodate various sizes of the edges of a doorway frame. Looking back to FIG. 2, it can be seen that the purpose of the brackets 38 is to securely hold the plate 70 and not allow its movement in any direction after installation.

Figure 4:
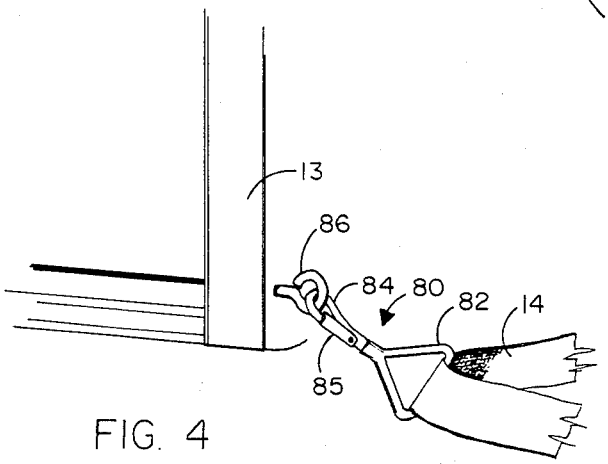
FIG. 4 is a view showing a method securing the leg strap means of the invention to a doorway.
Figure 5:
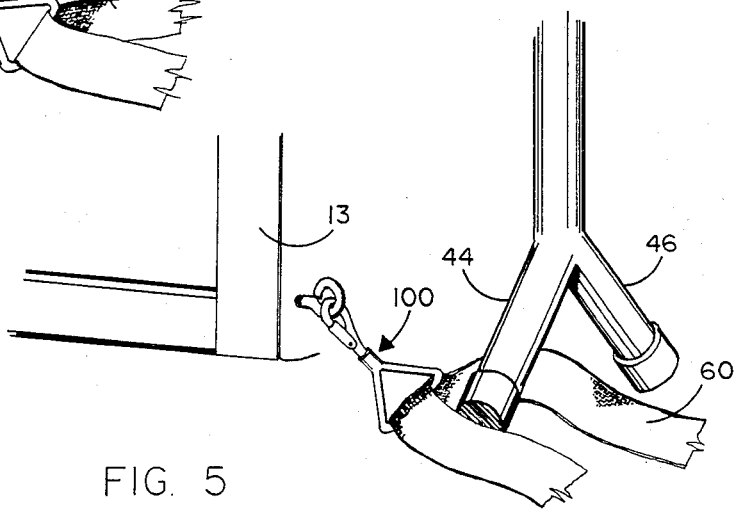
FIG. 5 is an alternate method of securing the strap means.

In FIGS. 4 and 5 there are shown two arrangements of the strap means. In FIG. 4 the securing means 80 comprises a buckle having a ring portion 82, and a C-shaped hook 84 which attaches to a second hook 86 secured to the door frame 13. The C-shaped hook 84 has a spring 35 which prevents any inadvertent release of the C-shaped hook 84 from the second hook 86. The strap 14 can pass through the ring portion 82 and can slide therein freely.

In FIG. 5, the strap 60 is shown to loop between the legs 44 and 46 of an upright support means, as well as through the ring portion of a buckle 100. In this case, the strap means are secured by the buckle 100 to the doorframe 13, and the legs 44 and 46 provide additional safety factor to restrain the strap 60 in case of accidental release of the buckle 100. Of course, as shown in FIG. 2, the strap means 60 may be restrained by the legs 44 and 46, without the use of a buckle 100. Optionally, if two straps are used, they may be attached directly to the leg 44 or 46, as shown for strap **60*b* in FIG. 4**.

The operation of the present device may now be described briefly. To use the device of FIG. 2, the user puts his feet through the loops 64, then puts the pelvic region of his body against the padded cylinder 12 and bends forward until the upper portion of his body above the pelvic region hangs down from the padded cylinder 12. If the padded cylinder is rotatable, it will assist in moving the body of the user over the cylinder. The user raises his feet while bending over, or after he has bent over the padded cylinder 12. The user stretches his feet away from the pelvic region. The user may also spread his feet apart substantially in the shape of a V. His feet are restrained by the strap 60, which in turn is held by the legs 46 of the supports 40 in FIG. 2. In FIG. 1, the strap 60 is attached by securing means 16 to the doorframe 13 and also by the legs 22 of the upright support 18. The user may use his hands to reach the floor and support himself when he is bent over the cylinder 12. It will be noted that in the operation of the device of FIG. 2, the upper portion of the body of the user can be maintained in a substantially perpendicular relation to his legs with the user facing towards his feet.

After the user has positioned himself on the exercising device, with the upper portions of this body hanging over the padded cylinder and his legs stretched out horizontally, the user may engage in active or passive exercises. The user accomplishes passive exercises by merely hanging in the described position and permitting the gravitational force to work on his back muscles and the spinal cord. For active exercises, the user may rock or swing his body using the padded cylinder as the fulcrum or pivot point, i.e. the user may swing his legs and the inverted upper portion of his body at the same time or keep his legs stationary while swinging the suspended upper portion of his body. The user may also move his feet apart substantially in the shape of a V and may additionally maintain his legs at different heights. The legs of the user have a great degree of freedom since they are restrained only by the strap means. The user can move his legs separately or jointly in any manner desired, together with or independent of the movement of the suspended upper portion of his body. In this manner, the intensity of the therapeutic value of the exercises is increased sharply since there are three forces acting on the back of the user, namely, the gravitational force, the momentum of the swing, and the force of the legs in their outstretched or actively moving position.

The configuration and installation of the device of FIG. 2 is preferably such that the padded cylinder 12 is rotatable at all times. However, a non-rotatable cylinder 12 would also be within the purview of the invention. When the user is bent over, the adjustable buckle 62 is within his easy reach and he can adjust the length of the strap 60 so as to stretch his legs as far out as desired in relation to the inverted portion of his body. In other words, if the user desires, he can limit the height to which his feet will rise by merely adjusting the buckle 62. However, it has been found that the best result of an exercise for the back of a person is obtained when the user permits at least one of his feet to rise to substantially the height of the padded cylinder 12.

It can be seen that in FIGS. 1 and 2 the strap means comprises a single length of strap which loops through the legs 46 of the upright support means. However, it should be understood that it would be possible to use two straps, each one of them being attached at their first end. The first ends of the two straps may be secured to legs 46 and/or secured by securing means 16 to the doorframe 13. For example, in FIG. 4, the strap 14 may be securely fastened to the ring portion 82, instead of being merely looped therethrough. In this case strap 14 would represent strap 60*a* of FIG. 4. The second ends of the two straps may be provided with loops as in FIGS. 1 and 2.

In FIG. 1 and 2, where the strap means is shown to comprise a single length of strap, the strap may be arranged such that when one leg is moved up, it would cause a tug or pull on the other leg and move it down. In this manner the legs can be restrainingly moved up and down alternatively. If desired, the strap means could be arranged such that movement of one leg is independent of the movement of the other leg, for example, by providing two different straps that are independently secured. It should be noted also that if the strap means are made somewhat elastic, that would permit the user to gently pull his legs up a little beyond the height permitted by the length of the strap means. This would add a new dimension to the exercise that can be performed using the device of the present invention.

It should be emphasized that the purpose of this device is not merely to permit the user to maintain his body portion above the pelvis in an inverted manner, but also to allow him, at the same time, to restrainingly stretch out his legs away from his suspended body as far as possible, to move his feet apart in the shape of a V and also move his legs to different heights. The user can rock or swing the inverted upper portion of his body while stretching his legs out or moving his legs up and down separately or in unison to apply additional force on his back to enhance the value of the exercise. The straps allow controlled movement of the legs.

It should be noted that while the device has been described in conjunction with a doorway, it may be used apart from a doorway, for example in a gymnasium. To utilize the present device without the use of a doorway, the padded cylinder 12 may be suitably supported on a frame to which the straps 60 may be suitably secured. For example, in FIGS. 4 and 5, the doorframe 13 may represent a portion of the frame. The user would be able to utilize the device in the same manner as described with reference to FIG. 1 and 2. The particular arrangement described herein of using the device in conjunction with a doorway provides an advantage in that the device may be utilized in apartments and houses where a large space such as in a gymnasium is not available.

The present device may be manufactured as a portable unit such that a user may carry one easily with him.

While the present invention has been described in particular relation to the drawings attached hereto, it should be understood that other and further modifications, apart from those shown or suggested herein, may be made within the scope and spirit of the invention. It is understood that this invention is not to be restricted to the particular drawings shown herein but is to be restricted and limited only by the claims and the full range of equivalency that each element thereof is entitled to.

What is claimed is:

1. A device for exercising the back of a user in a doorway comprising:

(a) horizontal support means secured in said doorway at about the height of the pelvic region of the user for supporting the weight of the user when the pelvic region of the user is disposed on said horizontal support means;

(b) securing means for securing said horizontal support means in said doorway; and (c) strap means attached at and extending from a base portion of the doorway for restraining the feet, said strap means having loops wherein the user may securely position his feet, said strap means being of sufficient length for permitting the user to extend and raise his feet to substantially the height of said horizontal support means while the pelvic region of said user is disposed on said horizontal support means;

(d) said strap means comprising a single length of strap looped through buckle means attached at said base portion such that the strap means can slide through said buckle means.

2. A device for exercising the back of a user comprising:

(a) upright support means having a base portion;

(b) horizontal support means supported on said upright support means at about the height of the pelvic region of the user for supporting the weight of the user when the pelvic region of the user is disposed on said horizontal support means; and (c) strap means attached at and extending from substantially the level of said base portion and coupled to the feet of the user for restraining the feet, said strap means being of sufficient length for permitting the user to extend and raise his feet to substantially the height of said horizontal support means while the pelvic region of said user is disposed on said horizontal support means;

(d) said strap means comprising a single length of strap looped through buckle means attached at said base portion such that the strap means can slide through said buckle means.

3. A device for exercising the back of a user in a doorway comprising:

(a) horizontal support means secured in said doorway at about the height of the pelvic region of the user for supporting the weight of the user when the pelvic region of the user is disposed on said horizontal support means;

(b) securing means for securing said horizontal support means in said doorway;

(c) strap means attached at and extending from a base portion of the doorway for restraining the feet, said strap means having loops wherein the user may securely position his feet, said strap means being of sufficient length for permitting the user to extend and raise his feet to substantially the height of said horizontal support means while the pelvic region of said user is disposed on said horizontal support means; and (d) upright support means positioned at each end of said horizontal support means for providing support thereto;

(e) said strap means comprising a single length of strap having one of said loops at each end, each of said upright support means having two legs supported at floor level, and said strap means being looped between said two legs of each of said upright support means.

4. The device of claim 2, wherein each of said upright support means comprise two divergent legs supported at a base level, and said strap means are secured by one of said two divergent legs.

5. A device for exercising the back of a user in a doorway comprising:

(a) horizontal support means secured in said doorway at about the height of the pelvic region of the user for supporting the weight of the user when the pelvic region of the user is disposed on said horizontal support means;

(b) securing means for securing said horizontal support means in said doorway;

(c) strap means attached at and extending from a base portion of the doorway for restraining the feet, said strap means having loops wherein the user may securely position his feet, said strap means being of sufficient length for permitting the user to extend and raise his feet to substantially the height of said horizontal support means while the pelvic region of said user is disposed on said horizontal support means; and (d) upright support means positioned at each end of said horizontal support means for providing support thereto;

(e) said strap means being looped through buckle means secured at said base portion and also secured by said upright support means such that the strap means can slide through said buckle means.

6. The device of claim 1, wherein said strap means comprise two straps, one for leg, having their first ends secured to said base portion of the doorway.

7. A device for exercising the back of a user in a doorway comprising:

(a) horizontal support means secured in said doorway at about the height of the pelvic region of the user for supporting the weight of the user when the pelvic region of the user is disposed on said horizontal support means;

(b) securing means for securing said horizontal support means in said doorway;

(c) strap means attached at and extending from a base portion of the doorway for restraining the feet, said strap means having loops wherein the user may securely position his feet, said strap means being of sufficient length for permitting the user to extend and raise his feet to substantially the height of said horizontal support means while the pelvic region of said user is disposed on said horizontal support means; and (d) upright support means positioned at each end of said horizontal support means for providing support thereto;

(e) said upright support means comprising two divergent legs supported at a base level, and said strap means being slidingly secured to said doorway and to one leg of each of said upright support means.

8. The device of claim 7, wherein said strap means comprise two straps, one for each leg, having their first ends secured to said upright support means.

* * * * *

UNITED STATES PATENT AND TRADEMARK OFFICE

CERTIFICATE OF CORRECTION

PATENT NO. : 4,522,391

DATED : 11 June 1985

INVENTOR(S) : Rundall, George

It is certified that error appears in the above—identified patent and that said Letters Patent is hereby corrected as shown below:

Column 8, line 24 after "for" insert --each--.

Signed and Sealed this

*Eighth* Day of *October 1985*

[SEAL]

*Attest:*

DONALD J. QUIGG

*Attesting Officer*

*Commissioner of Patents and Trademarks—Designate*